US008065959B1

(12) United States Patent
Shulte

(10) Patent No.: US 8,065,959 B1
(45) Date of Patent: Nov. 29, 2011

(54) EXPLOSIVE DEVICE

(76) Inventor: David J. Shulte, Harbor Springs, MI (US)

( * ) Notice: Subject to any disclaimer, the term of this patent is extended or adjusted under 35 U.S.C. 154(b) by 247 days.

(21) Appl. No.: 12/489,089

(22) Filed: Jun. 22, 2009

(51) Int. Cl.
*F42B 25/00* (2006.01)

(52) U.S. Cl. ..... 102/473

(58) Field of Classification Search ..... 102/473, 102/477, 499, 363, 369, 382, 371; 89/1.52, 89/1.11, 1.1
See application file for complete search history.

(56) References Cited

U.S. PATENT DOCUMENTS

| | | | | | |
|---|---|---|---|---|---|
| 571,909 | A * | 11/1896 | Scribner | ..... | 102/477 |
| 1,464,221 | A * | 8/1923 | Safford | ..... | 102/365 |
| 1,723,804 | A * | 8/1929 | Nair et al. | ..... | 102/369 |
| 1,754,950 | A * | 4/1930 | Henocque et al. | ..... | 378/119 |
| 2,253,021 | A * | 8/1941 | Dunn | ..... | 102/499 |
| 2,578,726 | A * | 12/1951 | Moore | ..... | 102/369 |
| 2,804,804 | A * | 9/1957 | Cumming | ..... | 89/1.1 |
| 3,811,359 | A * | 5/1974 | Marchese et al. | ..... | 89/1.813 |
| 4,873,928 | A * | 10/1989 | Lowther | ..... | 102/323 |
| 5,088,411 | A * | 2/1992 | Kurokawa et al. | ..... | 102/200 |
| 5,146,044 | A * | 9/1992 | Kurokawa et al. | ..... | 102/202.5 |
| 5,361,737 | A * | 11/1994 | Smith et al. | ..... | 123/143 B |
| 5,411,225 | A * | 5/1995 | Lannon et al. | ..... | 244/137.1 |
| 5,673,554 | A * | 10/1997 | DeFreitas et al. | ..... | 60/39.821 |
| 6,152,039 | A * | 11/2000 | Lee et al. | ..... | 102/200 |
| 6,324,982 | B1 * | 12/2001 | Eybert-Berard et al. | ..... | 102/363 |
| 2006/0011083 | A1 * | 1/2006 | Perry et al. | ..... | 102/205 |

* cited by examiner

*Primary Examiner* — Michael Carone
*Assistant Examiner* — Reginald Tillman, Jr.
(74) *Attorney, Agent, or Firm* — The Weintraub Group, P.L.C.

(57) ABSTRACT

The present invention provides an explosive device for use with a warhead comprising a rupturable core having a spherical interior chamber which is filled with a volume of a flammable gas. A frequency generator resonates the gas at a high frequency to fully resonate the gas to produce a new and more powerful type of explosion. Means for securing the frequency generator to the core are also provided, as well as a detonator having a high-temperature metal as a conductive material and means for inserting the conductive material into the core.

15 Claims, 3 Drawing Sheets

FIG 1
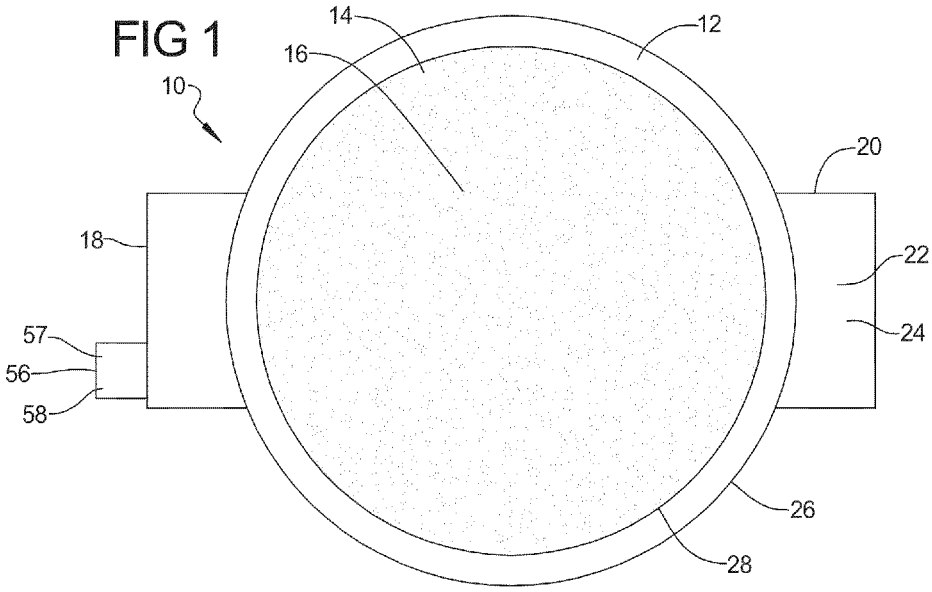
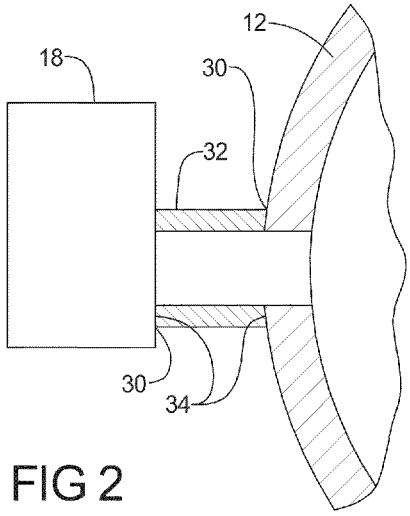
FIG 2

EXPLOSIVE DEVICE

BACKGROUND OF THE INVENTION

1. Field of the Invention

The present invention pertains to an explosive device. More particularly, the present invention pertains to an explosive device for use with a warhead. Even more particularly, the present invention pertains to an explosive device for use with a warhead fueled by a gas.

2. Description of the Prior Art

Various types of warheads exist in the prior art which have been used for many years. For example, warheads using explosive chemicals, such as gunpowder, have been in common use for hundreds of years. Other more recent warheads have been devised which involve the dispersion of chemical or biological particles upon impact with a target. In addition, nuclear warheads have been functional since World War II. However, the uses of chemical, biological, or nuclear warheads have drawn severe criticism from the public as a result of the harm to bystanders that occur.

Therefore, there remains a need for a new reliable replacement warhead, or RRW, which is highly effective at delivering a controlled payload to a target, and which results in minimal harm to non-targeted bystanders. In addition, it is desired that such an RRW could be scalable for use in a wide range of applications, ranging from a hand-held weapon to an intercontinental ballistic missile.

The present invention, as is detailed herein below, seeks to provide a new RRW by providing an explosive device for use with a warhead fueled by a gas. The present invention provides a new type of explosive device which is non-radioactive and non-contaminatory. Unlike nuclear weapons, the present invention does not cause electromagnetic fallout or electromagnetic communication disturbances. Rather, the present invention provides an explosive device which can be used in a humane manner so as to not harm bystanders because it provides a very fast, controlled, and complete burn over a precisely defined radius of destruction.

SUMMARY OF THE INVENTION

According to the preferred embodiment hereof, the present invention provides an explosive device for use with a warhead comprising: (a) a core having a spherical interior chamber, the interior chamber filled with a volume of a flammable gas; (b) a frequency generator for resonating the gas at a high frequency; (c) means for securing the frequency generator to the core; and (d) a detonator including a conductive material and means for inserting the conductive material into the core.

For a more complete understanding of the present invention, reference is made to the following detailed description and accompanying drawing. In the drawing, like reference characters refer to like parts throughout the views in which:

BRIEF DESCRIPTION OF THE DRAWING

FIG. 1 is a cross-sectional view of a first embodiment of the present invention hereof;

FIG. 2 is an enlarged cross-sectional view of a waveguide and the means for attaching the frequency generator to the core;

DETAILED DESCRIPTION OF THE PREFERRED EMBODIMENT

Figure 3:
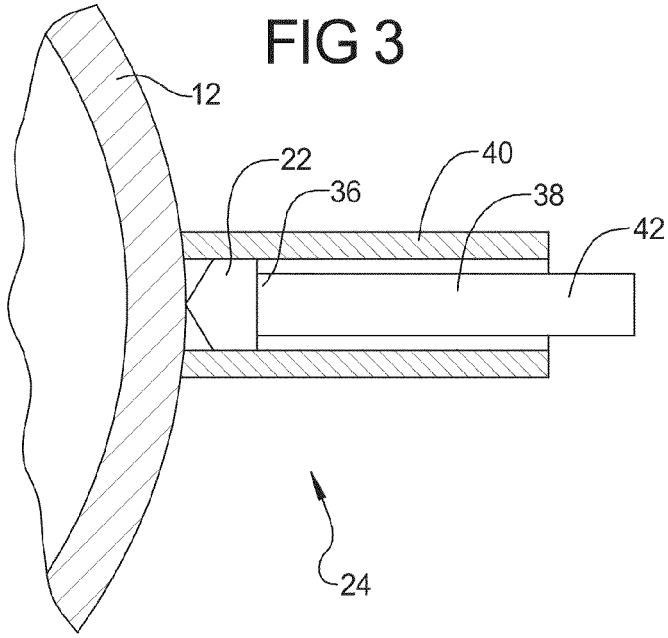
FIG. 3 is an enlarged cross-sectional view of a cylinder and slidable rod for detonating the explosive device.

In accordance with the present invention and as shown generally in FIG. 1, there is provided an explosive device 10 for use with a warhead comprising a rupturable core 12 having a spherical interior chamber 14 which is filled with a volume of a flammable gas 16, a frequency generator 18 attached to the core 12 for resonating the gas 16 at a high frequency, and a detonator 20 including a conductive material 22 and means for inserting 24 the conductive material 22 into the core 12, thereby creating an explosion.

The core 12 includes the spherical interior chamber 14 having a smooth surface. The interior chamber 14 is preferably lined with a smooth lining, such as polished glass or ceramic, to maximize the peak efficiency and power of the explosive device.

The core 12 has an exterior surface 26 that can be of any shape which is suitable for use herewith. Although it is not necessary, the exterior 26 of the core 12 can be spherical so that it matches that of the interior chamber 14.

The core 12 is comprised of a material which can withstand the rigors of being fired from a tank or a firearm and which can sustain airborne in-flight turbulence. Likewise, the core 12 material also has properties which allow the core 12 to rupture upon detonation, as described in further detail below. Any suitable material which fits these criteria can be used. Preferably, the core 12 is comprised of glass, ceramic, or a high-tensile strength plastic.

While the radius of the core 12 can be of any size which is suitable for use with a particular embodiment (as discussed further below), the radius is preferably an even-numbered divisible of $\Pi$ (i.e., 3.14159265 . . . ) or $\Phi$ (i.e., 1.6180339 . . . ), or a close approximation thereof.

For purposes which will be discussed in further detail below, the interior chamber 14 is filled with the volume of a flammable gas 16. The gas 16 is preferably pressurized at a pressure greater than atmospheric pressure. Although any suitable flammable gas can be used, the gas 16 is preferably a light gas such as hydrogen or methane. The gas 16 is injected into the core 12 during assembly of the explosive device 10. Alternatively, a proper volume of the gas 16 can also be housed in a pressurized sealed cartridge (not shown). The cartridge is attached to the core 12 such that when the seal is pierced, the pressurized flammable gas 16 is expelled into the interior chamber 14 of the core 12.

The explosive device 10 also includes a frequency generator 18 for resonating the gas 16 molecules at a high frequency. The frequency generator 18 resonates the gas molecules at an amplitude and frequency sufficient to resonate the gas molecules at a single peak intensity, or a "standing wave resonance." The frequency generator 18 is any suitable type of frequency generator known in the art, such as a traveling-wave tube, a magnetron, a gyrotron, a klystron, or the like. The type of frequency generator used will be dictated, in part, by the size of the explosive device 10 deployed for any particular application. In order to sufficiently resonate the gas 16, the frequency generator 18 preferably produces a frequency of at least 2.4 GHz. The frequency generator 18 is attached to the explosive device 10 as described below.

A power source 56 for operating the frequency generator 18 is also provided. The power source 56 can be a DC battery 57 which holds an adequate charge for a sufficiently-long period such that the gas molecules are fully resonated and have reached a standing wave resonance throughout the entire gaseous contents so that the gas is resonating as one complete mass. The power source 56 can be electrically connected to the frequency generator 18 by a switch 58 so that the explosive device 10 is live only when necessary. The switch 58 can be an inertia switch, whereby the circuit is completed when the explosive device 10 is launched or fired. The switch 58 can also be manually activated via a remote control.

As shown in FIG. 2, the present invention can also include a waveguide 30 for directing the extracted RF energy from the frequency generator 18 to the interior chamber 14 of the explosive device 10. The waveguide 32 is a structure which guides a wave, such as an electromagnetic wave. The waveguide 32 may be formed from either a conductive or dielectric material, depending upon the frequency of the wave, and is usually rectangular in cross-section.

Also provided are means for attaching 30 the frequency generator 18 to the core 12. If a waveguide 32 is provided, the means for attaching 30 can also attach the waveguide 32 to both the frequency generator 18 and the core 12. The means for attaching 30 includes fasteners such as bolts, welding, or the like.

The core 12, frequency generator 18, and waveguide 32 are hermetically sealed in order to contain the pressurized gas 16. A plurality of gaskets 34 are provided to ensure that the gas 16 remains pressurized within the interior chamber 14 of the core 12. At least one gasket from the plurality of gaskets 34 is provided as required between each of the core 12 and the waveguide 32, as well as between the waveguide 32 and the frequency generator 18.

It is to be appreciated by one having ordinary skill in the art that the gas 16 may not escape while under pressure and that the plurality of gaskets 34 is provided because the pressurized gas 16 must be properly contained within the explosive device 10 prior to an explosion. Each of the gaskets in the plurality of gaskets 34 are formed from any suitable type of material known in the art for providing a hermetic seal, such as an elastomer.

The present invention also includes a detonator 20 having a conductive material 22 and means for inserting 24. The means for inserting 24 is provided to insert the conductive material 22 into the core 12. The conductive material 22 may be any suitable type of high-temperature metal, such as iridium, tungsten, molybdenum, platinum, or the like. The conductive material 22 may be provided in any suitable shape which is conducive to increasing the surface area of the conductive material 22, such as a triangle, a square, a circle, the Star of David, or the like. Also, irregular shapes, such as flakes, may be used.

As noted above, the present invention, also, includes the means for inserting 24 the conductive material 22 into the core 12. For instance, as shown in FIG. 3, the conductive material 22 can be disposed at a first end 36 of a rod 38, the rod 38 being slidably disposed within a cylinder 40. A second end 42 of the rod 38 extends outwardly of the cylinder 40, and the first end 36 of the rod 38 is positioned adjacent to the core 12. The means for inserting 24 is positioned on the leading face, or end, of the explosive device 10. As the explosive device 10 contacts its target, the second end 42 of the rod 38 is abutted against the target and the rod 38 is pushed into the cylinder 40. The first end 36 of the rod 38 and the conductive material 22 are pressed into the core 12, rupturing a portion of the core 12, thereby allowing the conductive material 22 into the interior chamber 14. As the conductive material 22 enters the interior chamber 14, an explosion occurs, as discussed in further detail below.

Figure 4:
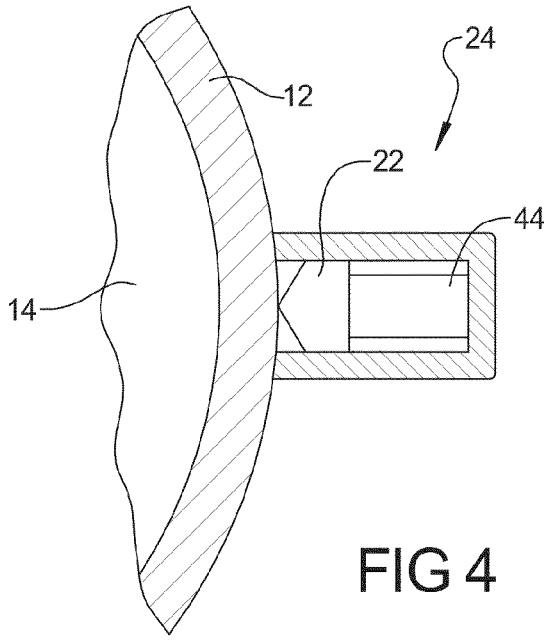
FIG. 4 is an enlarged cross-sectional view of a solenoid and a conductive material for detonating the explosive device.

As shown in FIG. 4, the means for inserting 24 the conductive material 22 into the core 12 can also comprise an electromechanical device 44, such as a solenoid, which is attached to the conductive material 22 and which, upon activation, ruptures a portion of the core 12 as it forces the conductive material 22 into the interior chamber 14. The electromechanical device 44 can be activated by a device such as a timer, altimeter, inertia switch, a mercury switch, or the like.

Figure 5:
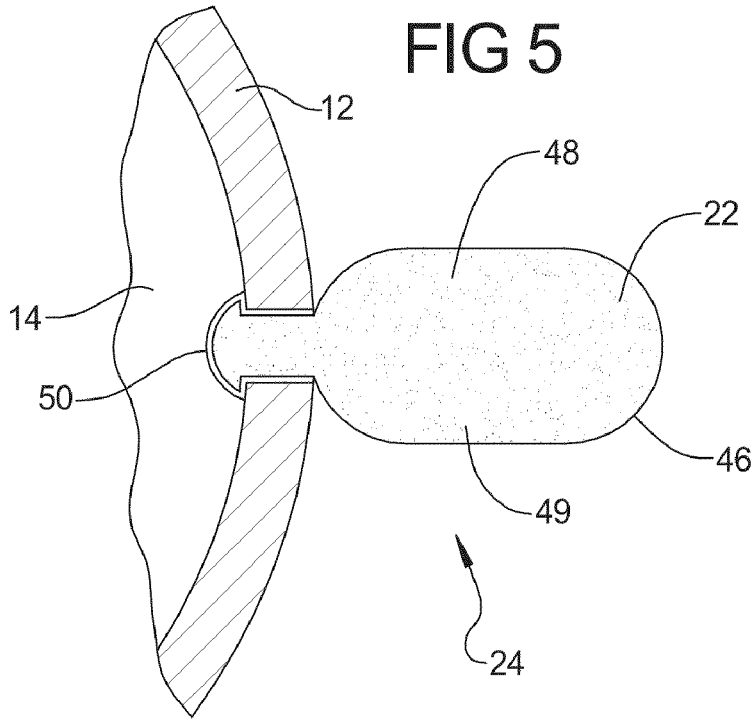
FIG. 5 is an enlarged cross-sectional view of a sealed cartridge comprising a flaked metal and pressurized gas for detonating the explosive device.

As shown in FIG. 5, the means for inserting 24 the conductive material 22 into the core 12 can also be a cartridge 46 filled with a flaked metal 48 and a second pressurized gas 49, such as hydrogen or carbon dioxide. The second gas 49 is at a pressure higher than the gas 16. The cartridge 46 has a piercable, or rupturable, seal 50. The cartridge 46 is attached to the core 12 such that when the seal 50 is pierced, the second pressurized gas 49 expels the conductive material 22 into the interior chamber 14 of the core 12. The seal 50 can be pierced by means such as described above, such as by a slidable rod upon impact, or by an electromechanical device 44 such as a solenoid. As the conductive material 22 enters the interior chamber 14, an explosion occurs, as discussed below.

Figure 6:
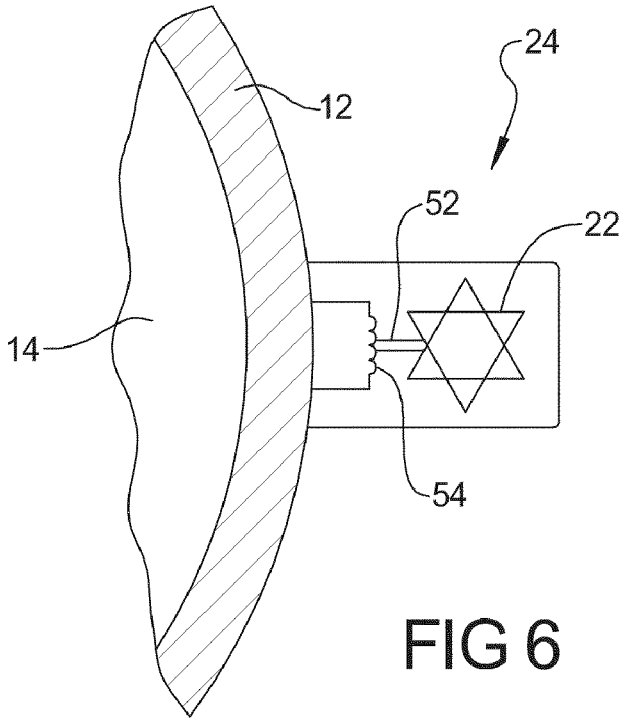
FIG. 6 is an enlarged cross-sectional view of a spring-loaded latch having a conductive material attached thereto for detonating the explosive device.

As shown in FIG. 6, the means for inserting 24 the conductive material 22 into the core 12 can also be a spring-tensioned latch 52 having the conductive material 22 attached thereto. A spring 54 is provided for rotating the latch from a "loaded" position to a "fired" position. Preferably the spring 54 is a helical torsional spring. Upon impact with the target, the latch 52 is released, and the spring 54 rotates the conductive material 22 into and through a small portion of the core 12 so that the conductive material 22 enters the interior chamber 14, thereby resulting in an explosion.

As the conductive material 22 enters the interior chamber 14, the conductive material 22 is exposed to the electromagnetic field generated by the frequency generator 18. The electromagnetic field excites the freely moving electrons in the conductive material 22, causing them to arc from the molecules of the conductive material 22 to the air, thereby creating a spark, which is not unlike a tiny bolt of lightning. This is similar to the phenomenon which occurs when metal is placed in a microwave oven. The spark ignites the resonating gas, thereby resulting in an explosion.

It is to be appreciated by one having ordinary skill in the art that the present invention is scalable in size for various applications, as needed. For instance, the present invention can be used with any suitable type of warhead or explosive device, such as: an intercontinental ballistic missile (ICBM); an air-launched cruise missile (ALCM); bombs, such as gravity bombs; sea-launched cruise missiles (SLCM); air-to-air rockets and missiles; surface-to-air rockets and missiles; rocket and mortar tube launched exploding grenades; rifle and pistol fired exploding grenades; shoulder-fired exploding grenades; tank-fired exploding projectiles and grenades; and so forth.

Furthermore, the present invention may be launched or fired from any suitable type of vehicle or object, including: any air, land, sea, or space vehicle capable of firing an exploding projectile; stationary-firing devices; space satellite fired exploding projectiles; space vehicle fired exploding projectiles; and so forth.

The frequency generator 18 can comprise a traveling-wave tube when the present invention is used with small-scale weapons, such as rifles, pistols, or hand-held grenade launchers.

A traveling-wave tube, or TWT, is an electronic device used to amplify radio frequency signals to high power. A TWT can produce frequencies in the range of 300 MHz to 50 GHz. A TWT is an elongated vacuum tube with a heated cathode that emits electrons at one end. A magnetic containment field around the tube focuses the electrons into a beam, which then passes down the middle of a wire helix that stretches from the RF input to the RF output, the electronic beam finally striking a collector at the other end. A directional coupler, which can be either a waveguide or an electromagnetic coil, is fed with the low-powered radio signal that is to be amplified, and is positioned near the emitter, and which induces a current into the helix. The helix acts as a delay line in which the RF signal travels at approximately the same speed along the tube as the electron beam. The electrons are "bunched" together as the electromagnetic field interacts with the electron beam due to the current in the helix. The electromagnetic field then induces more current back into the helix.

In this embodiment, a solid state having an RFI source providing a frequency in the range of about 2.4 GHz to about 5.8 GHz or higher is provided by the TWT. The TWT emits the frequency into the interior chamber 14 which is filled with the gas 16, preferably, hydrogen. The gas 16 is pressurized within the core 12, at a pressure of up to or greater than, 100 psi. The mass of the gas 16 in this embodiment may be as small as 0.001 gram, although it may be larger.

When the present invention is used with medium-scale weapons, such as rocket and mortar tube launched grenades, or tank-fired grenades or projectiles, the frequency generator 18, preferably, comprises a magnetron.

A magnetron is a high-powered vacuum tube that generates non-coherent microwaves. A magnetron consists of a hot filament, or cathode, which is kept at or pulsed to a high negative potential by a high-voltage, direct-current power supply. The cathode is built into the center of an evacuated, lobed, circular chamber. A magnetic field parallel to the filament is imposed by a permanent magnet. The magnetic field causes the electrons, which are attracted to the positively charged outer portion of the chamber, to spiral outward in a circular path rather than moving directly to the positive anode. Spaced around the rim of the chamber are cylindrical cavities. The cavities are open along their length and connect the common chamber space. As electrons sweep past these openings they induce a resonant, high-frequency radio field in the chamber, which in turn causes the electrons to bunch into groups. A portion of this field is extracted with a short antenna that is connected to a waveguide.

Medium-sized applications require an output from the frequency generator 18 in the range of about 500 Watts to about 1500 Watts. A very narrow bandwidth RF output from the frequency generator 18 is emitted directly into the interior chamber 14 via a waveguide 32. The frequency generator 18 and waveguide 32 are hermetically sealed to the core 12. In this embodiment, the gas 16 is at a pressure of about 100 psi or higher, and the mass of the gas 16 can be as small as 0.5 gram, although it may be larger.

When the present invention is used with large-scale weapons, such as ICBM's, or ALCM's, the frequency generator 18 comprises a gyrotron or a klystron.

A gyrotron is a high-powered vacuum tube which emits millimeter-wave beams by bunching electrons with cyclotron motion in a strong magnetic field. Output frequencies range from about 20 GHz to about 250 GHz, and gyrotrons can be designed for pulsed or continuous operation. A gyrotron is a type of free electron MASER (Microwave Amplification by Stimulated Emission of Radiation). It has high power at millimeter wavelengths because its dimensions can be much larger than the wavelength, unlike conventional vacuum tubes, and it is not dependent on material properties, as are conventional MASER's. Gyrotrons are often used to heat plasmas.

A klystron is a specialized linear-beam vacuum tube. Klystrons are used as amplifiers at microwave and radio frequencies to produce both low-power reference signals for superheterodyne radar receivers and to produce high-power carrier waves for communications. They are the driving force for modern particle accelerators. Klystron amplifiers have the advantage over the magnetron of coherently amplifying a reference signal so its output may be precisely controlled in amplitude, frequency, and phase. Klystrons have an output in the range of 50 megawatts at frequencies nearing 3 GHz. Many klystrons have a waveguide for coupling microwave energy into and out of the device, although it is also quite common for lower power and lower frequency klystrons to use coaxial couplings instead. In some cases a coupling probe is used to couple the microwave energy from a klystron into a separate external waveguide. Klystrons operate by amplifying RF signals by converting the kinetic energy in a DC electron beam into radio frequency power. A beam of electrons is produced by a thermionic cathode (a heated pellet of low work function material), and accelerated by high voltage electrodes (typically in the tens of kilovolts). This beam is then passed through an input chamber. RF energy is fed into the input chamber at, or near, its natural frequency to produce a voltage which acts on the electron beam. The electric field causes the electrons to bunch because electrons which pass through during an opposing electric field are accelerated while later electrons are slowed, thereby causing the previously continuous electron beam to form bunches at the input frequency. The RF current carried by the beam will produce an RF magnetic field, and this will in turn excite a voltage across the gap of subsequent resident activities. In the output chamber, the developed RF energy is coupled out. The spent electron beam, with reduced energy, is then captured in a collector.

Large-sized applications require an output from the frequency generator 18 in the range of about 1500 Watts or greater. The frequency generator 18 can emit the RF output directly into the interior chamber 14 via a waveguide 32. The frequency generator 18 can also be directly attached to the core 12 to directly emit the RF output into the core 12. The frequency generator 18 and waveguide 32 are hermetically sealed to the core 12. The interior chamber 14 of the core 12 is filled with the gas 16 pressurized to about 100 psi or higher. The mass of the gas 16 in this embodiment may be as small as 1 pound, although it may be larger.

Although various embodiments of the invention have been disclosed for illustrative purposes, it is understood that one skilled in the art can make variations and modifications without departing from the spirit of the invention.

What is claimed is:

1. An explosive device comprising:

a rigid rupturable core having an exterior and a spherical interior chamber, the interior chamber filled with volume of a flammable gas within the interior chamber;

a frequency generator for resonating the gas at a high frequency;

means for securing the frequency generator to the exterior of the core; and a detonator including a conductive material and means for inserting the conductive material into the core.

2. The explosive device of claim 1 comprising a waveguide positioned between the frequency generator and the core for transmitting RF waves from the frequency generator to the core, the waveguide being attached to the frequency generator and the core by the means for securing.

3. The explosive device of claim 1 wherein the core comprises a material selected from the group consisting of glass, ceramic, or a high-tensile strength plastic.

4. The explosive device of claim 1 wherein the conductive material is a metal.

5. The explosive device of claim 1 wherein the gas is hydrogen.

6. The explosive device of claim 1 wherein the frequency generator resonates the gas at a frequency of at least 2.4 GHz.

7. The explosive device of claim 1 wherein the frequency generator is a traveling-wave tube.

8. The explosive device of claim 1 wherein the frequency generator is a magnetron.

9. The explosive device of claim 1 wherein the frequency generator is a gyrotron.

10. The explosive device of claim 1 wherein the frequency generator is a klystron.

11. The explosive device of claim 1 wherein the explosive device is hermetically sealed and the gas is pressurized.

12. The explosive device of claim 4 wherein the metal is a flaked metal, and the means for inserting the conductive material includes a sealed cartridge comprising a pierceable seal and a pressurized second gas, the flaked metal being housed within the sealed cartridge, whereby, upon detonation the seal is pierced and the flaked metal enters the interior chamber.

13. The explosive device of claim 1 wherein the interior chamber has a radius substantially equal to an even-numbered multiple or divisible of Π.

14. The explosive device of claim 1 wherein the interior chamber has a radius substantially equal to an even-numbered multiple or divisible of Φ.

15. An explosive device comprising:

a rigid rupturable core having an exterior and a spherical interior chamber, the interior chamber filled with volume of a flammable gas within the interior chamber;

a frequency generator for resonating the gas at a high frequency, the frequency generator being secured to the exterior of the core;

a detonator comprising a conductive material and means for inserting the conductive material into the core, the conductive material comprising a flaked metal, and the means for inserting the conductive material includes a sealed cartridge comprising a pierceable seal and a pressurized second gas, the flaked metal being housed in the sealed cartridge, whereby, the explosive device is detonated when the seal is pierced, the flaked metal exits from the sealed cartridge into the interior chamber, and electricity arcing the metal ignites the flammable gas.

* * * * *

UNITED STATES PATENT AND TRADEMARK OFFICE

CERTIFICATE OF CORRECTION

PATENT NO. : 8,065,959 B1
APPLICATION NO. : 12/489089
DATED : November 29, 2011
INVENTOR(S) : David J. Schulte It is certified that error appears in the above-identified patent and that said Letters Patent is hereby corrected as shown below:

Title Pg, Item (76) Inventor: please correct the spelling of the Inventor's name from "David J. Shulte" to "David J. Schulte"

Signed and Sealed this
Twenty-seventh Day of December, 2011

David J. Kappos

David J. Kappos
*Director of the United States Patent and Trademark Office*